US006907644B2

(12) United States Patent
Többen

(10) Patent No.: US 6,907,644 B2
(45) Date of Patent: Jun. 21, 2005

(54) APPARATUS FOR PNEUMATICALLY FEEDING AT LEAST ONE SPINNING PREPARATION MACHINE, FOR EXAMPLE A CARDING MACHINE OR CLEANER

(75) Inventor: Robert Többen, Mönchengladbach (DE)

(73) Assignee: Trutzschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/769,909

(22) Filed: Feb. 3, 2004

(65) Prior Publication Data

US 2004/0216279 A1 Nov. 4, 2004

(30) Foreign Application Priority Data

Feb. 7, 2003 (DE) ..... 103 05 049

(51) Int. Cl.[7] ..... D01G 15/40
(52) U.S. Cl. ..... 19/200; 19/105
(58) Field of Search ..... 19/65 A, 65 R, 19/98, 105, 200, 204, 205

(56) References Cited

U.S. PATENT DOCUMENTS

| | | | | |
|---|---|---|---|---|
| 4,240,180 A | * | 12/1980 | Wood et al. | 19/105 |
| 4,353,667 A | | 10/1982 | Mandl et al. | |
| 4,404,710 A | | 9/1983 | Wood | |
| 4,701,981 A | * | 10/1987 | Leifeld | 19/105 |
| 4,779,311 A | * | 10/1988 | Leifeld | 19/105 |
| 4,940,367 A | | 7/1990 | Stäheli et al. | |
| 5,143,485 A | | 9/1992 | Faas et al. | |
| 5,247,722 A | * | 9/1993 | Leifeld | 19/105 |
| 2002/0124354 A1 | | 9/2002 | Pferdmenges et al. | |

FOREIGN PATENT DOCUMENTS

| | | |
|---|---|---|
| DE | 34 42 942 A1 | 5/1986 |
| DE | 38 55 311 T2 | 12/1996 |
| DE | 198 12 437 A1 | 9/1999 |
| DE | 299 14 892 U1 | 2/2000 |
| DE | 201 02 245 U1 | 5/2001 |
| DE | 100 35 829 C2 | 7/2002 |
| EP | 0 303 023 A1 | 2/1989 |
| GB | 2 169 322 A | 7/1986 |

* cited by examiner

*Primary Examiner*—Gary L. Welch
(74) *Attorney, Agent, or Firm*—Venable LLP; Robert Kinberg

(57) ABSTRACT

Automatic modification of volumetric air flow in an apparatus for pneumatically feeding a spinning preparation machine, by means of fiber-flock charging shafts located upstream of individual spinning preparation machines and connected to a pneumatic fiber-transporting line, the transporting line connected by way of a fiber material feed fan to the fiber-processing machine upstream.

A set of characteristic curves describing air flow is stored in a characteristic curve set element; a measurement signal for the pressure difference at the fan and values relating to rotation of the fan are ascertained in a computer unit. The computer unit determines value of the volumetric air flow from the characteristic curves. In the event of departure from a desired value for the volumetric air flow, the operating point for the speed of rotation of the fan is displaced to the desired value.

17 Claims, 6 Drawing Sheets

APPARATUS FOR PNEUMATICALLY FEEDING AT LEAST ONE SPINNING PREPARATION MACHINE, FOR EXAMPLE A CARDING MACHINE OR CLEANER

CROSS REFERENCE TO RELATED APPLICATION

This application claims priority from German Patent Application No. 103 05 049.3 dated 7 Feb. 2003, the disclosure of which is incorporated herein by reference.

BACKGROUND OF THE INVENTION

The invention relates to an apparatus for pneumatically feeding at least one spinning preparation machine, for example a carding machine or cleaner. Pneumatic feed means are known in which feeding is accomplished by means of fibre-flock charging shafts, which are located upstream of the individual spinning preparation machines and which are connected to a pneumatic fibre-transporting line, the transporting line being connected by way of a fibre material feed fan to the fibre-processing machine located upstream, and wherein automatic modification of the amount of air is arranged to be carried out.

In practice, radial fans are used for feeding material to charging shafts through a pneumatic transporting line, the air-related technical properties of those fans being described by a set of characteristic curves. The characteristic curves describe the volumetric air flow in dependence upon the total pressure difference being produced at the fan. A multiplicity of curves for various speeds of rotation of a fan is accordingly produced. If the total pressure difference being produced is then altered by external factors such as different charging pressures at material shafts, the volumetric air flow will consequently also vary in accordance with the characteristic curve. However, varying volumetric air flows have an extremely disadvantageous effect on the ability to adjust the material feed. Because relatively high volumetric flows are necessary on the intake side and low volumetric flows are desired on the feed side, a volumetric flow that is as constant as possible is desirable. However, because of the different charging pressures at a material shaft, the volumetric flow is not constant. Customarily, the volumetric air flow is determined by means of differential pressure measurement at a volumetric flow measurement nozzle and is displayed. The fan speed of rotation is set to a fixed value by means of a frequency converter. This is usually carried out only when the system is being re-set and involves a considerable amount of work. Nevertheless, even when a system is in a preselected, desirable state of operation, variations in the charging conditions still occur, caused by changes during operation. The pressures in the individual shafts, which vary because of changing charging conditions in the fibre material shaft, especially due to the material requirements of the downstream processing machine (e.g. carding machine), give rise to varying volumetric air flows because of variations in the pressure in the transporting line.

In a known apparatus (EP 303 023), provision is made for modified control of the amount of flocks fed into a conveying system when the number of fibre-processing carding machines changes. When such a change is made, for example when a number of carding machines are switched off, it is not necessary to modify the amount of air by appropriately displacing the characteristic curve of the fan; the amount of conveying air adjusts itself automatically to the number of carding machines in production. Accordingly, the possible operating points according to the set of characteristic curves for the fan are not held in the control system. It is consequently not possible for the actual value of the amount of air to be compared to the desired value for the operating point. In particular, the operating point of the fan is dependent upon the total pressure difference, that is to say it is also dependent upon the pressure on the intake side of the fan and, in the known apparatus, that pressure is not measured. Only the static pressure at the fan outlet is measured, which pressure is used for regulating the amount of fibre flocks in the transporting line. It is disadvantageous therein that—in the case of a constant number of carding machines—it is not possible to carry out automatic modification in accordance with the pressure variations in the fibre material shafts and consequently it is not possible to make the amount of conveying air more uniform.

In contrast thereto, it is an aim of the invention to provide an apparatus of the kind mentioned at the beginning which avoids or mitigates the mentioned disadvantages and which especially can keep the volumetric flow for the conveying of fibre material substantially or completely constant in spite of different charging pressures at at least one fibre material shaft.

SUMMARY OF THE INVENTION

The invention provides an apparatus for processing textile fibre material comprising a fibre-processing machine;

at least one spinning preparation machine;

a pneumatic fibre-transporting line for transporting fibre material pneumatically from the fibre-processing machine to a said spinning preparation machine and comprising at least an upstream line portion, a downstream line portion and a fibre material feed fan between said upstream and downstream line portions;

a differential pressure measurement device for measuring the pressure difference between said upstream line portion and said downstream line portion;

a rotational speed measurement device for determining the speed of rotation of the fan; and a control device comprising a storage device for storing characteristic curves describing the dependence of volumetric air flow in the downstream line portion upon said pressure difference;

wherein the control device is arranged to determine from the measured pressure difference and the determined speed of rotation the actual volumetric air flow and to effect adjustment of the apparatus towards a desired value of the volumetric air flow.

As a result of the fact that the set of characteristic curves for the fan is held and stored, for example, in mathematical form in the control device, the actual volumetric air flow can be calculated for the actual measured total pressure difference at the fan and the actual speed of rotation of the fan, the latter being known, for example, by means of a frequency converter. As a result of comparison with a desired volumetric air flow, the desired volumetric air flow can be set by modifying the speed of rotation. By that means, even in the event of different charging pressures in the fibre material charging shaft, automatic setting of a constant or almost constant volumetric air flow is made possible.

Advantageously, the fan is a radial fan. Advantageously, a measurement element for measuring the total pressure difference (differential pressure measurement element) is associated with the fan. Advantageously, the characteristic curve set element is in the form of a writable and readable memory. Advantageously, the characteristic curve set element is integrated into a computer unit. Advantageously, a control device is integrated into the computer unit.

Advantageously, a desired value memory for the desired volumetric air flow is associated with the control device. Advantageously, a speed of rotation measurement device is associated with the drive motor for the fan. Advantageously, the speed of rotation measurement device is a frequency converter. Advantageously, the speed of rotation measurement device is tachogenerator. Advantageously, the electronic control and regulation device is a microcomputer having a microprocessor. Advantageously, the differential pressure measurement element, the speed of rotation measurement device and a speed of rotation actuating element for the fan are connected to the electronic control and regulation device. Advantageously, a volumetric flow measurement element is connected to the electronic control and regulation device.

Furthermore, the invention provides an apparatus for pneumatically feeding at least one spinning preparation machine, for example, a carding machine or cleaner, by means of fibre-flock charging shafts, which are located upstream of the individual spinning preparation machines and which are connected to a pneumatic fibre-transporting line, the transporting line being connected by way of a fibre material feed fan to the fibre-processing machine located upstream, wherein automatic modification of the volumetric air flow (amount of air) is arranged to be carried out, and wherein, for the case of different charging pressures in at least one fibre-flock charging shaft, a set of characteristic curves describing the volumetric air flow in dependence upon the pressure difference at the fan is stored in a characteristic curve set element, the pressure difference being arranged to be determined by a differential pressure measurement element, a measurement signal for the actual pressure difference at the fan and also the values, arranged to be determined by a speed of rotation measurement device, relating to the actual speed of rotation of the fan are arranged to be ascertained in a computer unit, the computer unit is able to determine the actual value of the volumetric air flow from the set of characteristic curves and, in the event of departure from a desired value for the volumetric air flow, the operating point for the speed of rotation of the fan can be displaced to the desired value for the volumetric air flow.

DESCRIPTION OF PREFERRED EMBODIMENTS

Figure 1:
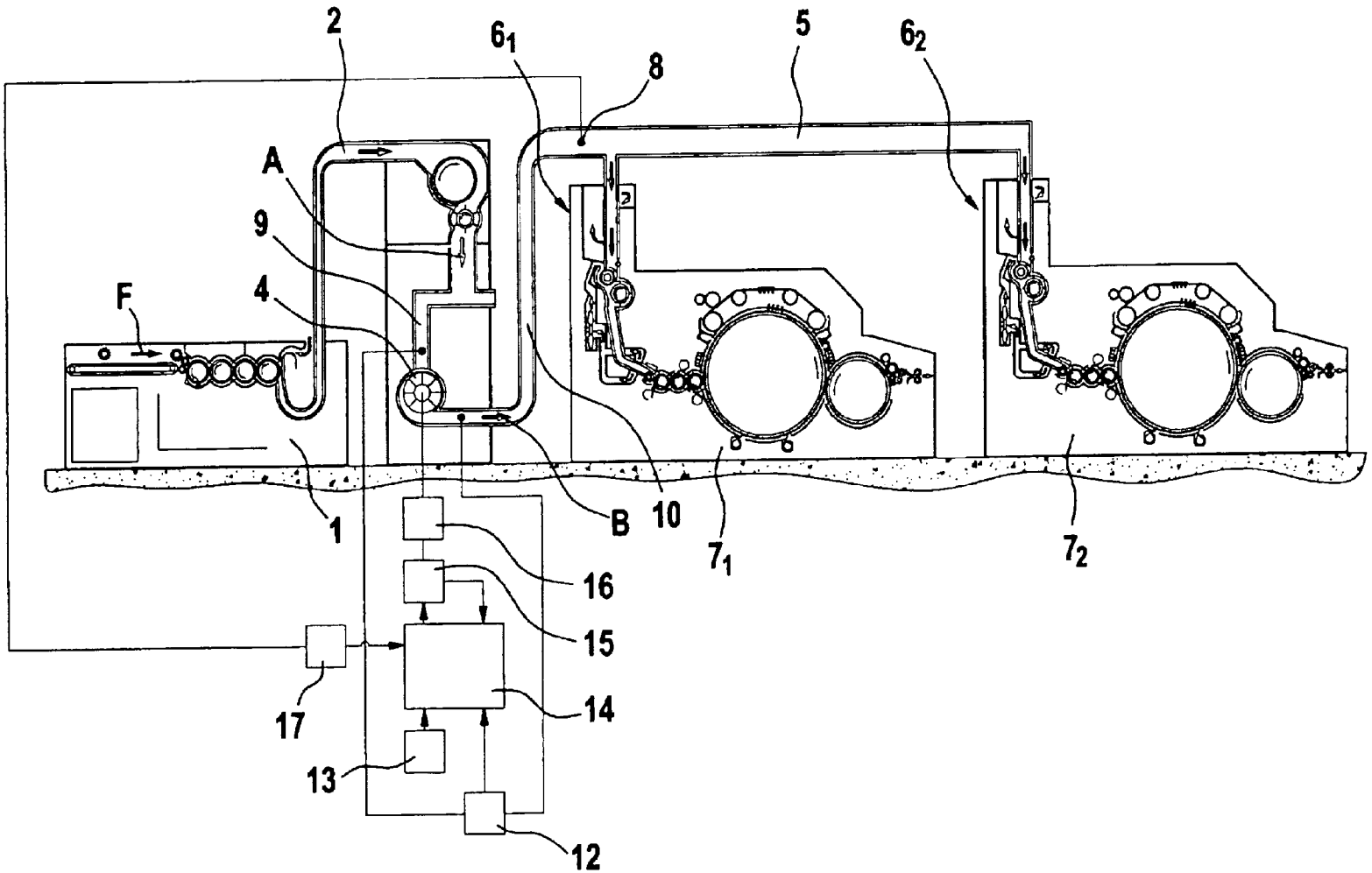
FIG. 1 is a diagrammatic side view of a spinning preparation installation having two carding machines and including an apparatus according to the invention with a generalised circuit diagram.

In a spinning preparation system according to FIG. 1, the fibre material F is fed from a bale opener (not shown) to a cleaning apparatus 1, for example a CVT 4 (trade mark) cleaner made by Trützschler GmbH & Co KG of M önchengladbach, Germany, by way of a mixer (not shown). From the final roller of the cleaner 1, the opened and cleaned fibre material is fed pneumatically, by way of a pipeline 2, to a fan 4 and is conveyed by the fan 4 into a pneumatic feeding and distribution line 5, to which two card feeders $\mathbf{6}_1$, $\mathbf{6}_2$, for example DIRECTFEED DFK (trade mark) feeders made by Trützschler GmbH & Co KG , and two carding machines $\mathbf{7}_1$, $\mathbf{7}_2$, for example, DK 903 (trade mark) high-performance carding machines made by the same company, are connected.

Mounted in a wall of the feeding and distribution line 5 is a pressure measurement element 8, which is in communication with a measurement value transducer 17, which converts the actual pressure values in the feeding and distribution line 5 and in the connected charging shafts $\mathbf{6}_1$, $\mathbf{6}_2$ into electrical signals and enters them into a control device 14, for example a computer. In the control device 14, the electrical signal for the actual pressure value is used for modifying the speed of rotation of the fan and, consequently, the volumetric air flow. In addition, there is associated with the fan 4 a differential pressure measurement element 12, which ascertains the pressure difference $\Delta P$ between the pressures in the intake line 9 and the delivery line 10 of the fan 4. The differential pressure measurement element 12 and a characteristic curve set element 13 are connected to a control device 14 (electronic control and regulation device) for example a microcomputer, which is in communication, by way of a frequency converter 15, with the drive motor 16 for the fan 4. The frequency converter 15 is in communication with the control and regulation device 14 by way of a further connection, by which the electrical signals corresponding to the speeds of rotation n of the fan 4 are communicated to the control and regulation device 14.

Figure 2:
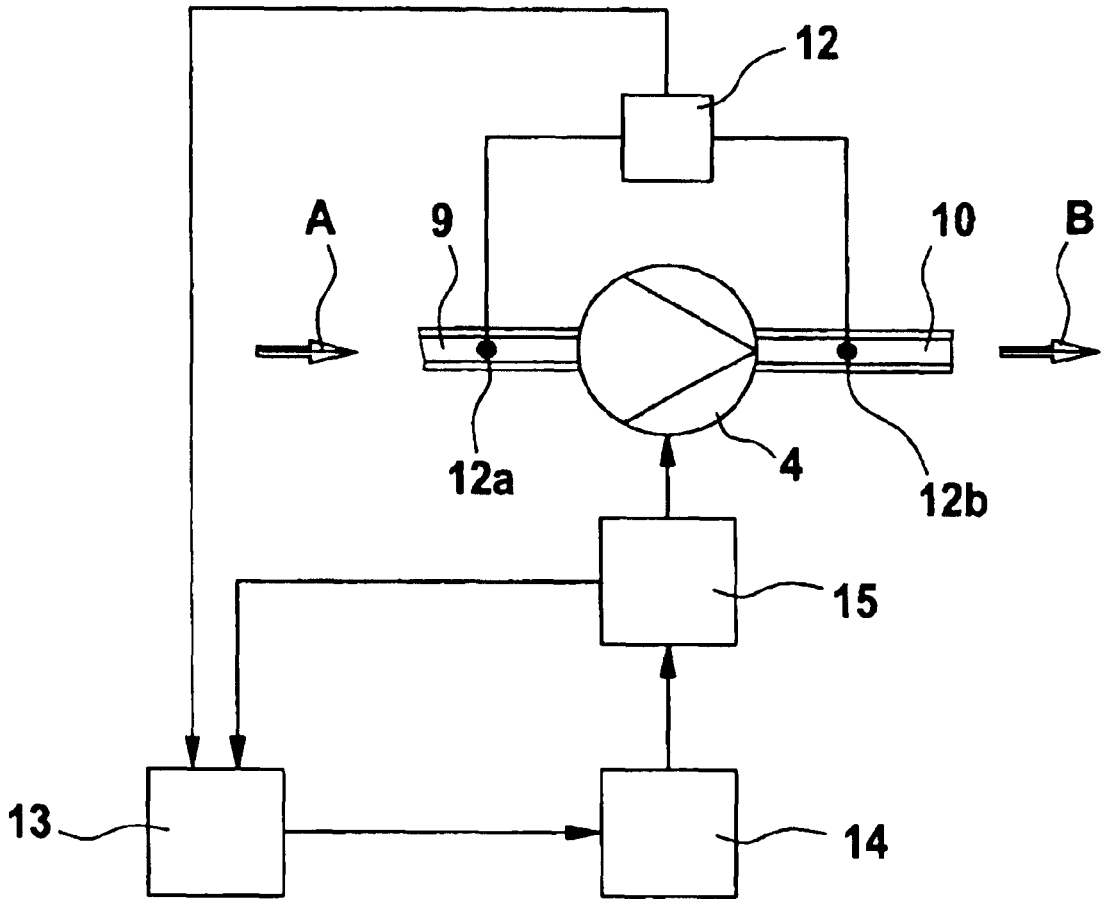
FIG. 2 is a generalised circuit diagram of an apparatus according to the invention having a differential pressure measurement element, speed of rotation measurement element, characteristic curve set element and electronic control and regulation device.

The embodiment of FIG. 2 includes intake pipeline 9 (intake side of the fan 4) for the conveyed air mixture A, the material-transporting fan 4 and the delivery pipeline 10 (delivery side of the fan 4) for the fibre/air mixture B. Associated with the intake pipeline 9 is one measurement sensor 12*a* and associated with the delivery line 10 is the other measurement sensor 12*b* of the differential pressure measurement element. Reference numeral 13 denotes a characteristic curve set element, in which the known set of characteristic curves for the fan 4 (see FIG. 3) is held in mathematical form. The actual speed of rotation n of the fan 4 is ascertained by way of the frequency converter 15. The volumetric air flow V in the delivery line 10 and consequently in the transporting line 5 and charging shafts $\mathbf{6}_1$, $\mathbf{6}_2$ is calculated in that manner by way of the measured total pressure difference $\Delta P$ at the fan 4 and the speed of rotation n, which is known by means of the frequency converter 15. As a result, it is possible for the volumetric air flow $\nabla$ to be kept at a constant level by continuously modifying the speed of rotation of the fan 4.

Figure 3:
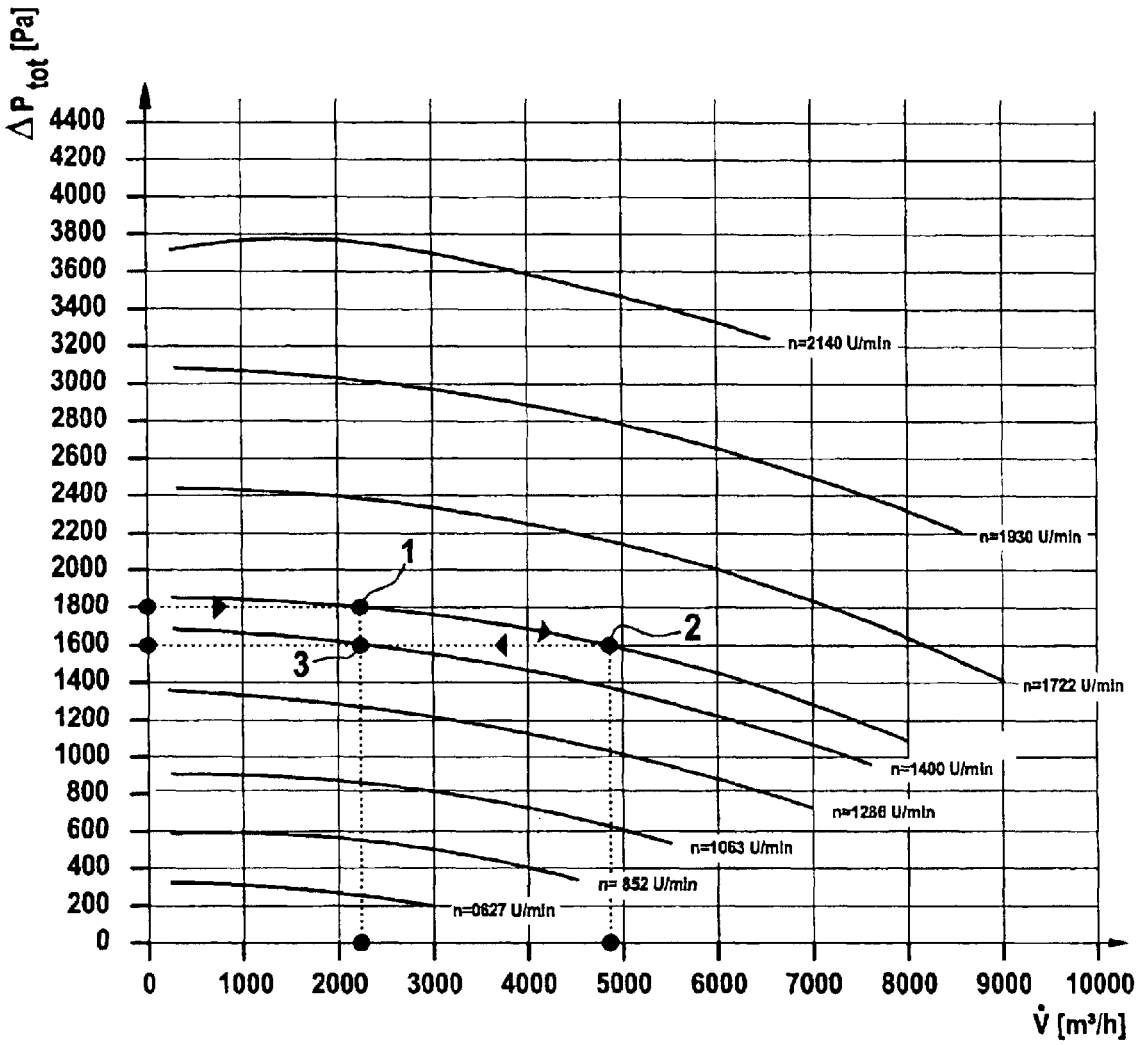
FIG. 3 is a graph showing fan characteristic curves of $\Delta P_{tot}$ against $\nabla$, with displacement of the operating point.
Figure 4:
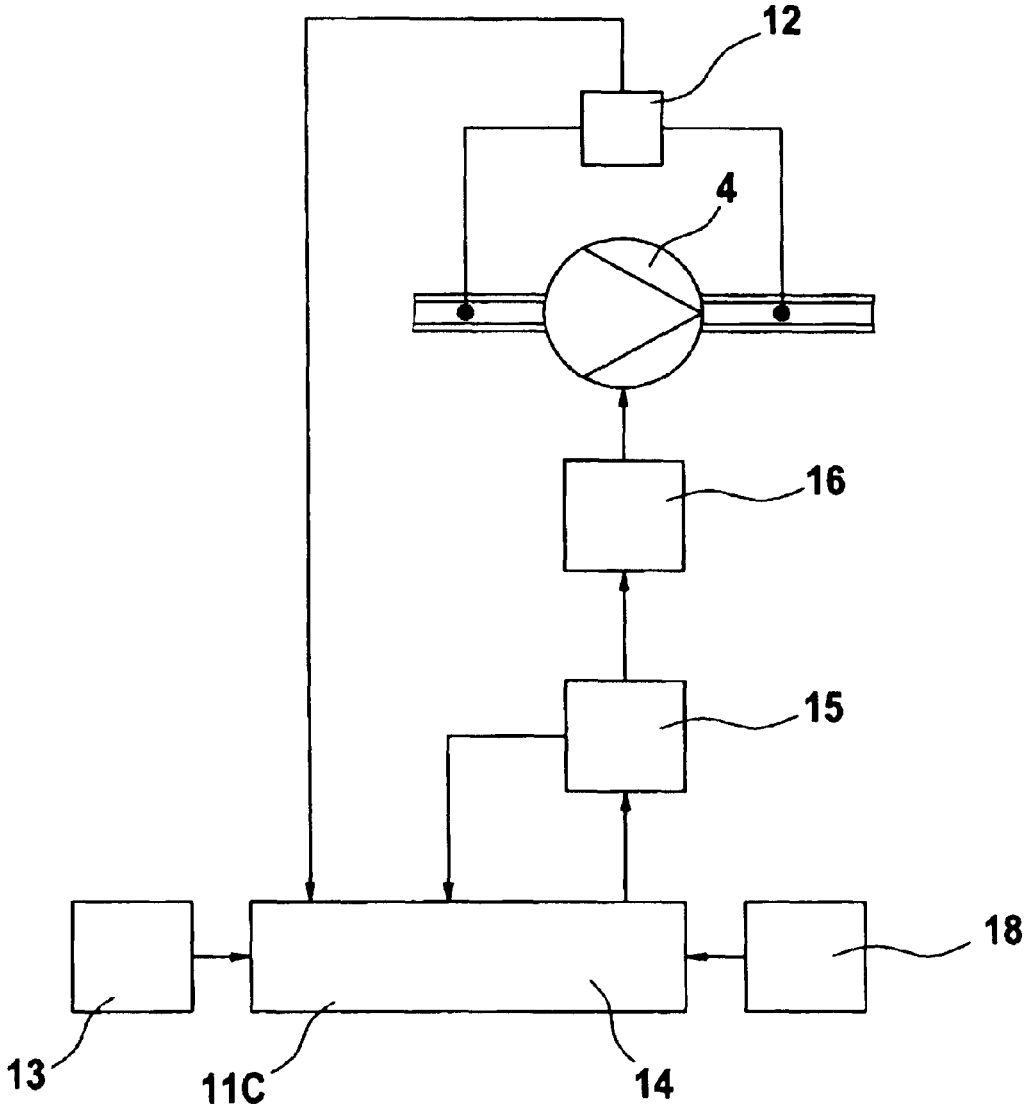
FIG. 4 shows a further embodiment of the apparatus according to the invention comprising a frequency converter.
Figure 5:
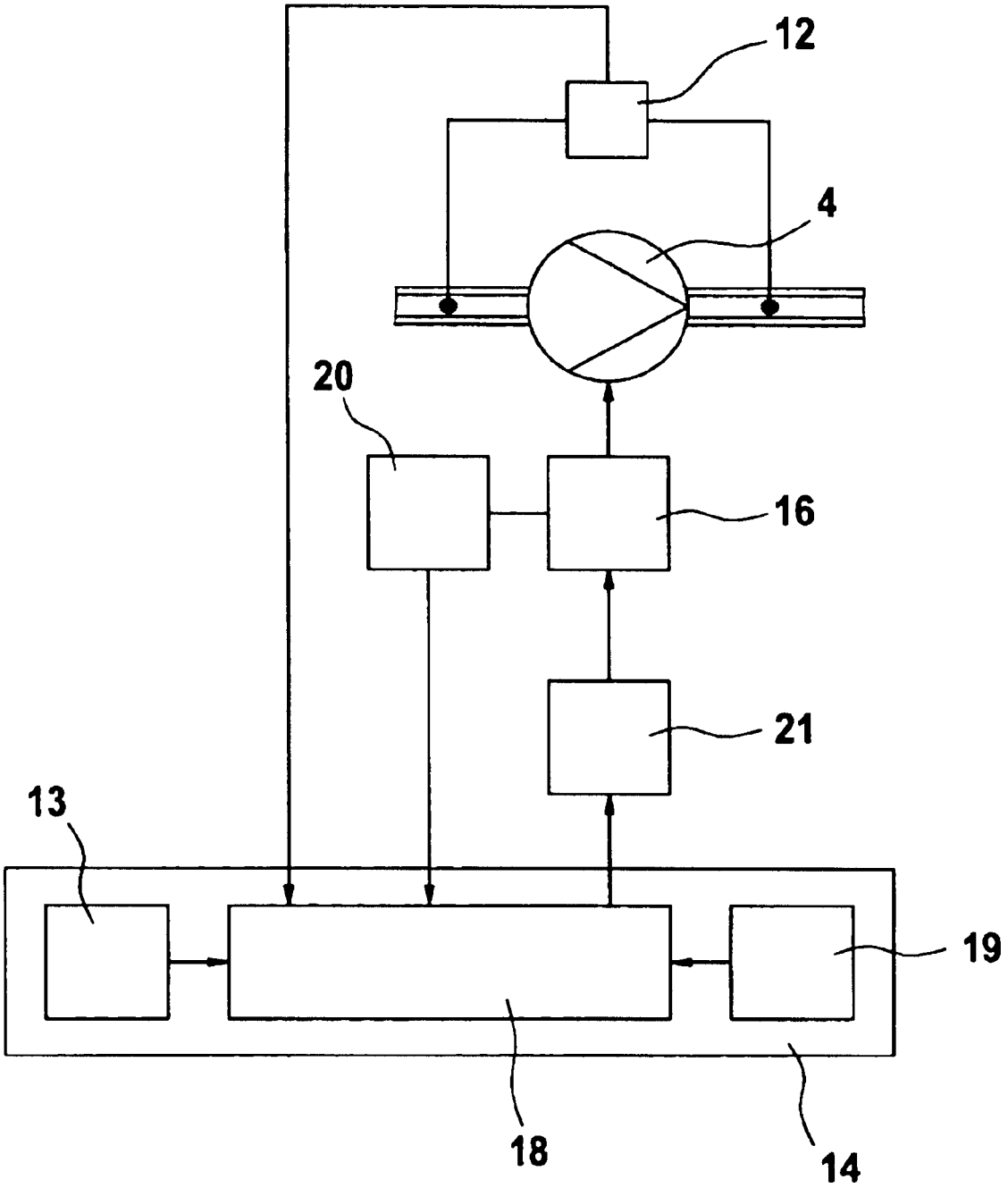
FIG. 5 shows a further embodiment of the apparatus according to the invention comprising a tachogenerator.

FIG. 3 shows the characteristic curves for the fan, which are determined by $\Delta P_{tot}$ (total pressure difference at the fan 4), $\nabla$ (volumetric air flow in the delivery line 10) and n (speed of rotation of the fan) and which are stored in the characteristic curve set element 13 (see FIGS. 1, 4 and 5).

EXAMPLE

1) Operating Point 1

The operating point 1 of the fan 4 is defined by the following parameters:

$\Delta P$=1800 (Pa)

n=1508 (rev./min.)

$\nabla$=2250 ($m^3$/h) (=desired value)

$\Delta P$=total pressure difference n=speed of rotation of fan $\nabla$=volumetric air flow 2) Operating Point 2

The pressure p in the charging shafts $\mathbf{6}_1$, $\mathbf{6}_2$ and, consequently, in the feeding and distribution line 5 decreases from 1800 Pa to 1700 Pa, for example as a result of a change in the amount of fibre material in the charging shafts $\mathbf{6}_1$, $\mathbf{6}_2$.

As a result, the operating point 2 of the fan 4 is displaced as follows:

$\Delta P$=1710 (Pa)

n=1508 (rev./min.)

$\nabla$=3750 ($m^3$/h) (=actual value)

When the pressure drops, the volumetric air flow $\nabla$ increases while the speed of rotation of the fan remains constant.

3) Operating Point 3

The speed of rotation n of the fan 4 is reduced (modified) from 1508 rev./min. to 1450 rev./min. Operating point 3 is, as a result, defined by the following parameters:

$\Delta P$=1710 (Pa)

n=1450 (rev./min.)

$\nabla$=2250 ($m^3$/h) (=desired value)

When the speed of rotation decreases, the volumetric air flow $\nabla$ decreases to the desired value 3650 $m^3$/h while the total pressure difference $\Delta P$ remains constant at the measured actual value 1710 Pa.

The volumetric air flow $\nabla$ is, in that manner, constantly adjusted to the prespecified desired value by modifying the speed of rotation n of the fan when the total pressure difference $\Delta P$ decreases.

FIG. 4 shows a generalised circuit diagram of a further embodiment, according to which the characteristic curve set element 13, which is a memory, and a controller 18 are connected as separate elements to the computing unit 14. The actual speed of rotation of the fan 4 is determined by means of the frequency converter 15—by means of the actual speed of rotation n of a variable drive motor 16 (electric motor).

In the embodiment of FIG. 5, the characteristic curve set element 13 and a controller 19 are integrated into the control device 14. Reference numeral 18 denotes a computer, for example a microcomputer having a microprocessor, and reference numeral 21 denotes an actuating element. The actual speed of rotation of the fan 4 is determined by means of a tachogenerator 20, which is connected to the drive motor 16.

Figure 6:
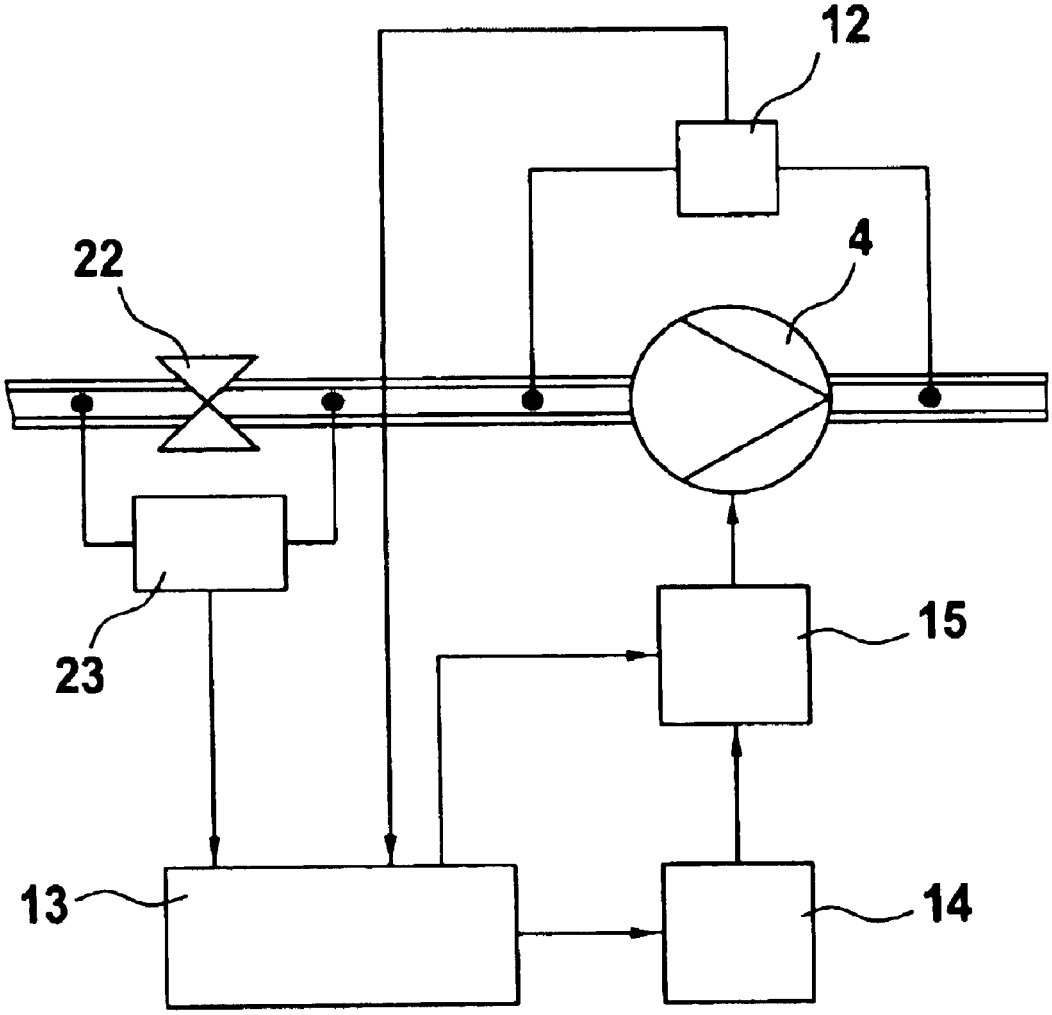
FIG. 6 shows an embodiment with differential pressure measurement at a volumetric flow measurement nozzle.

In the embodiment of FIG. 6, a volumetric flow measurement nozzle 22, with which there is associated a differential pressure measurement device 23, is integrated into the delivery line 10. (In FIG. 6, the direction of flow of the air/fibre mixture is from right to left, in contrast to FIG. 2). The volumetric air flow is determined by means of the differential pressure measurement at the volumetric flow measurement nozzle 22 and the total pressure difference $\Delta P$ is measured at the fan 4. Using the known set of characteristic curves for the fan 4, which are held in mathematical form in the control, it is also possible to determine the speed of rotation n of the fan 4.

Although the foregoing invention has been described in detail by way of illustration and example for purposes of clarity of understanding, it will be obvious that changes and modifications may be practiced within the scope of the appended claims.

What is claimed is:

1. The invention provides an apparatus for processing textile fibre material comprising:

a fibre-processing machine;

at least one spinning preparation machine;

a pneumatic fibre-transporting line for transporting fibre material pneumatically from the fibre-processing machine to a said spinning preparation machine and comprising at least an upstream line portion, a downstream line portion and a fibre material feed fan between said upstream and downstream line portions;

a differential pressure measurement device for measuring the pressure difference between said upstream line portion and said downstream line portion;

a rotational speed measurement device for determining the speed of rotation of the fan; and a control device comprising a storage device for storing characteristic curves describing the dependence of volumetric air flow in the downstream line portion upon said pressure difference;

wherein the control device is arranged to determine from the measured pressure difference and the determined speed of rotation the actual volumetric air flow and to effect adjustment of the apparatus towards a desired value of the volumetric air flow.

2. An apparatus according to claim 1, comprising as spinning preparation machine a carding machine or cleaning machine having a fibre feed shaft, the fibre feed shaft being in communication with the transport line.

3. An apparatus according to claim 1, in which the control device can effect adjustment of the speed of rotation of the fan.

4. An apparatus according to claim 1, in which the fan is a radial fan.

5. An apparatus according to claim 1, which comprises a measurement element for measuring the differential pressure across the fan.

6. An apparatus according to claim 1, comprising a writable and readable memory containing the characteristic curve set.

7. An apparatus according to claim 6, in which there is a computer unit incorporating the control device and the writable and readable memory.

8. An apparatus according to claim 1, in which the control device includes a desired value memory for desired values of the volumetric air flow.

9. An apparatus according to claim 1, comprising a drive motor for the feed fan, the rotational speed device being associated with the drive motor.

10. An apparatus according to claim 1, in which the rotational speed measurement device comprises a frequency converter.

11. An apparatus according to claim 1, in which the rotational speed measurement device comprises a tachogenerator.

12. An apparatus according to claim 1, which further comprises a speed of rotation actuating element for adjusting the speed of the fan.

13. An apparatus according to claim 12, in which the differential pressure measured device, the rotational speed measurement device and the speed of rotation actuation device are in communication with the control device.

14. An apparatus according to claim 1, further comprising a volumetric flow measurement element, which is in communication with the control device.

15. An apparatus according to claim 1, comprising a plurality of spinning preparation machines.

16. An apparatus for controlling the volumetric air flow in a transport line for transporting pneumatically fibre flocks, comprising a feed fan located in said transport line, an upstream transport line portion upstream of the fan and a downstream transport line portion downstream of the fan, and a pressure difference measurement device for determining a pressure differential across the fan, wherein a control device is provided for storing characteristic curves describing the dependence of volumetric air flow in said downstream transport line portion upon the said pressure differential and the control device is arranged to determine an actual value for the volumetric flow rate from a known value for the rotational speed of the fan and a measured value of the pressure differential and in the event of departure of the actual value of the volumetric flow rate from a desired value for the volumetric flow rate to adjust the rotational speed of the fan so as to cause the volumetric flow rate to be displaced towards the desired value thereof.

17. An apparatus according to claim 16, which comprises a rotational speed measurement device for determining the rotational speed of the fan to obtain said known value of the rotational speed.

* * * * *